US007217151B2

(12) United States Patent
Geibel et al.

(10) Patent No.: US 7,217,151 B2
(45) Date of Patent: May 15, 2007

(54) ELECTRICAL CONNECTOR WITH STRAIN RELIEF FEATURES

(75) Inventors: Dean E. Geibel, New Cumberland, PA (US); Steven E. Minich, York, PA (US); Donald K. Harper, Jr., Camp Hill, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/987,738

(22) Filed: Nov. 12, 2004

(65) Prior Publication Data

US 2006/0105615 A1 May 18, 2006

(51) Int. Cl.
*H01R 13/58* (2006.01)

(52) U.S. Cl. ..... 439/449; 439/74

(58) Field of Classification Search ..... 439/76.1, 439/82, 562, 547, 449, 567, 452
See application file for complete search history.

(56) References Cited

U.S. PATENT DOCUMENTS

| | | | | |
|---|---|---|---|---|
| 4,025,142 | A * | 5/1977 | Huber et al. | 439/470 |
| 4,168,877 | A | 9/1979 | Little et al. | 339/103 |
| 4,533,188 | A | 8/1985 | Miniet | 339/17 |
| 4,934,943 | A * | 6/1990 | Klein et al. | 439/547 |
| 4,993,965 | A | 2/1991 | Eck | 439/374 |
| 5,171,154 | A | 12/1992 | Casciotti et al. | 439/67 |
| 5,507,653 | A * | 4/1996 | Stoner | 439/74 |
| 5,707,242 | A * | 1/1998 | Mitra et al. | 439/74 |
| 5,745,347 | A * | 4/1998 | Miller et al. | 439/34 |
| 6,039,581 | A * | 3/2000 | DiMarco | 439/74 |
| 6,042,386 | A | 3/2000 | Cohen et al. | 439/60 |
| 6,095,856 | A * | 8/2000 | Horan et al. | 439/567 |
| 6,431,886 | B1 | 8/2002 | Ramey et al. | 439/101 |
| 6,475,023 | B2 | 11/2002 | Carneling | 439/488 |
| 6,974,344 | B2 * | 12/2005 | Comerci | 439/567 |
| 6,976,886 | B2 * | 12/2005 | Winings et al. | 439/79 |

* cited by examiner

*Primary Examiner*—Briggitte R. Hammond
(74) *Attorney, Agent, or Firm*—Woodcock Washburn LLP

(57) ABSTRACT

A preferred embodiment of a connector system includes a first electrical connector for mounting on a first substrate. The first electrical connector has a housing, and a contact mounted on the housing. The connector system also includes a second electrical connector for mounting on a second substrate. The second electrical connector includes a housing having a projection formed thereon, and a contact mounted on the housing. The second electrical connector is capable of mating with the first electrical connector so that the contact of the first electrical connector electrically contacts the contact of the second electrical connector and the projection contacts the first substrate so that at least a portion of the weight of the second electrical connector and the second substrate is transmitted to the first substrate by way of the projection.

19 Claims, 11 Drawing Sheets

ELECTRICAL CONNECTOR WITH STRAIN RELIEF FEATURES

FIELD OF THE INVENTION

The present invention relates to electrical connectors and, more particularly, to an electrical connector capable of being mated with a second electrical connector and having features for relieving strain associated with the second electrical connector.

BACKGROUND OF THE INVENTION

Electrical contact between two substrates, such as a motherboard 100 and a daughter card 102 shown in FIG. 1, can be established using a connector system 104. The connector system 104 may comprise a header connector 106 mounted on the daughter card 102, and a receptacle connector 108 mounted on the motherboard 100. For example, as shown in FIG. 1, the daughter card 102 may be oriented horizontally, and the motherboard 100 may be oriented vertically. The receptacle connector 106 therefore is suspended from the motherboard 100 by the connections between the receptacle connector 108 and the motherboard 100.

The receptacle connector 108 can be the primary (or the only) structure for supporting the header connector 106 and the daughter card 102. The connections between the receptacle connector 108 and the motherboard 100 thus can function as the primary or sole support for the header connector 106 and the daughter card 102. As the daughter card 102 can weigh up to several pounds, this type of mounting arrangement can subject the connections between the receptacle connector 108 and the motherboard 100 to substantial stresses.

The stresses induced by the weight of the daughter card 102 and the header connector 106 can have a detrimental effect on the connections between the receptacle connector 108 and the motherboard 100. This problem can be particularly troublesome in applications where the receptacle connector 108 is surface mounted, i.e., where the receptacle connector 108 is mounted on a mounting surface 100*a* of the motherboard 100 using solder connections (such as in a ball-grid array connector). Subjecting a solder connection to substantial levels of stress and thermal cycling can weaken the solder connection, and can lead to cracking and premature failure thereof. Such degradation can potentially reduce the reliability and the useful life of the connector system.

One known solution to the aforementioned problem is to configure the receptacle connector 106 with a strain relief post that protrudes into the motherboard. However, this solution is not without detriment. First, the receptacle should be able to float or move relative to the motherboard during reflow of the receptacle connector onto the motherboard. A strain relief post, which is inserted into a hole in the motherboard, can inhibit the movement of the receptacle connector during reflow. This restraint of movement can cause stress in post-reflow solder connections and prevent proper alignment of the receptacle connector contacts and the corresponding solder pads or vias. Second, even if the hole defined by the motherboard is supersized to allow play between the strain relief post and an inner surface of the strain relief hole, the post itself must contact the inner surface at some point to carry shear force to the motherboard. Therefore, a solderable strain relief post may be needed. This adds to the cost of the components and the process.

Another known solution is to attach guide pins to the motherboard and guide pin receiving receptacles on the daughtercard. This is usually a four part assembly that takes up valuable board real estate on the motherboard and the daughtercard and often requires mechanical attachment of the guide pins/guide pin receiving receptacles to the respective boards via an externally threaded shaft and an internally threaded nut. Again, this adds cost and takes up valuable space on the PCBs.

SUMMARY OF THE INVENTION

The present invention generally includes a strain relief on a mating end of a connector, and not on the mounting end connector. This configuration allows affirmative strain relief that is independent of the reflow process and separate mechanical connections.

A preferred embodiment of an electrical connector comprises a PCB mounting side, a mating side, an electrical contact, trace, or other pathway that extends between the PCB mounting side and the mating side, and a strain relief member that is positioned on the mating side of the electrical connector. The strain relief member provides relief for another electrical connector.

A preferred embodiment of a connector system comprises a first electrical connector for mounting on a first substrate. The first electrical connector comprises a housing, and a contact mounted on the housing.

The connector system also comprises a second electrical connector for mounting on a second substrate. The second electrical connector comprises a housing having a projection, and a contact mounted on the housing. The projection can be a pin and the housing can have a projection receiving cavity formed therein for receiving an end of the pin. Alternatively, the projection can be integrally formed with the housing.

The second electrical connector is capable of mating with the first electrical connector so that the contact of the first electrical connector electrically contacts the contact of the second electrical connector and the projection contacts the first substrate so that at least a portion of the weight of the second electrical connector and the second substrate is transmitted to the first substrate by way of the projection.

A preferred embodiment of a system for electrically connecting a first and a second electrical component comprises a first substrate having a hole formed therein, and a second substrate. The system also comprises a first electrical connector mounted on the first substrate and comprising a housing and a contact mounted on the housing, and a second electrical connector mounted on the second substrate for mating with the first electrical connector.

The second electrical connector comprises a housing having a projection that contacts the first substrate when the first and second electrical connectors are mated, and a connector mounted in the housing of the second electrical connector. The projection can be a pin and the housing can have a projection receiving cavity formed therein for receiving an end of the pin. Alternatively, the projection can be integrally formed with the housing.

A preferred embodiment of a header connector for mounting on a first substrate comprises a housing having a projection, and a plurality of contacts mounted on the housing. The projection can be a pin and the housing can have a projection receiving cavity formed therein for receiving an end of the pin. Alternatively, the projection can be integrally formed with the housing.

The header connector is capable of being mated with a receptacle connector mounted on a second substrate by moving the header connector in a first direction into contact with the receptacle connector. The projection can be inserted in the first direction into a hole formed in the second substrate as the header connector is mated with the receptacle connector so that the second substrate can support at least a portion of the weight of the header connector and the first substrate by way of the projection.

A preferred embodiment of a connector system for electrically connecting a motherboard and a daughter card comprises a surface-mount receptacle connector for mounting on the motherboard. The receptacle connector comprises a first housing, and plurality of first contacts mounted on the first housing.

The connector system also comprises a header connector for mounting on the daughter card and mating with the receptacle connector. The header connector comprises a second housing having a projection for suspending the header connector and the daughter card from the motherboard, and a plurality of second contacts mounted on the second housing for electrically contacting the plurality of second contacts. The projection can be a pin and the second housing can have a projection receiving cavity formed therein for receiving an end of the pin. Alternatively, the projection can be integrally formed with the second housing.

A preferred method for substantially isolating solder connections between a first electrical connector and a first substrate from the weight of a second substrate and a second electrical connector mounted on the second substrate when the first and the second electrical connectors are mated comprises substantially aligning a projection on a housing of the second connector with a hole formed in the first substrate, and inserting the projection in the hole as the first and second electrical connectors are mated.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF PREFERRED EMBODIMENTS

FIGS. 2 to 9 depict a preferred embodiment of an electrical connector system 10. The figures are referenced to a common coordinate system 11 depicted therein. The connector system 10 comprises a header connector 12, and a receptacle connector 14 that mates with the header connector 12. As discussed below in greater detail, the preferred embodiment shows the header connector 12 having male contacts, but the header connector 12 can carry female contacts that mate with corresponding male contacts carried by the receptacle connector 14. In addition, the preferred embodiment shows a right angle header connector 12. Co-planar connectors could also conceivably benefit from the disclosed invention.

Figure 1:
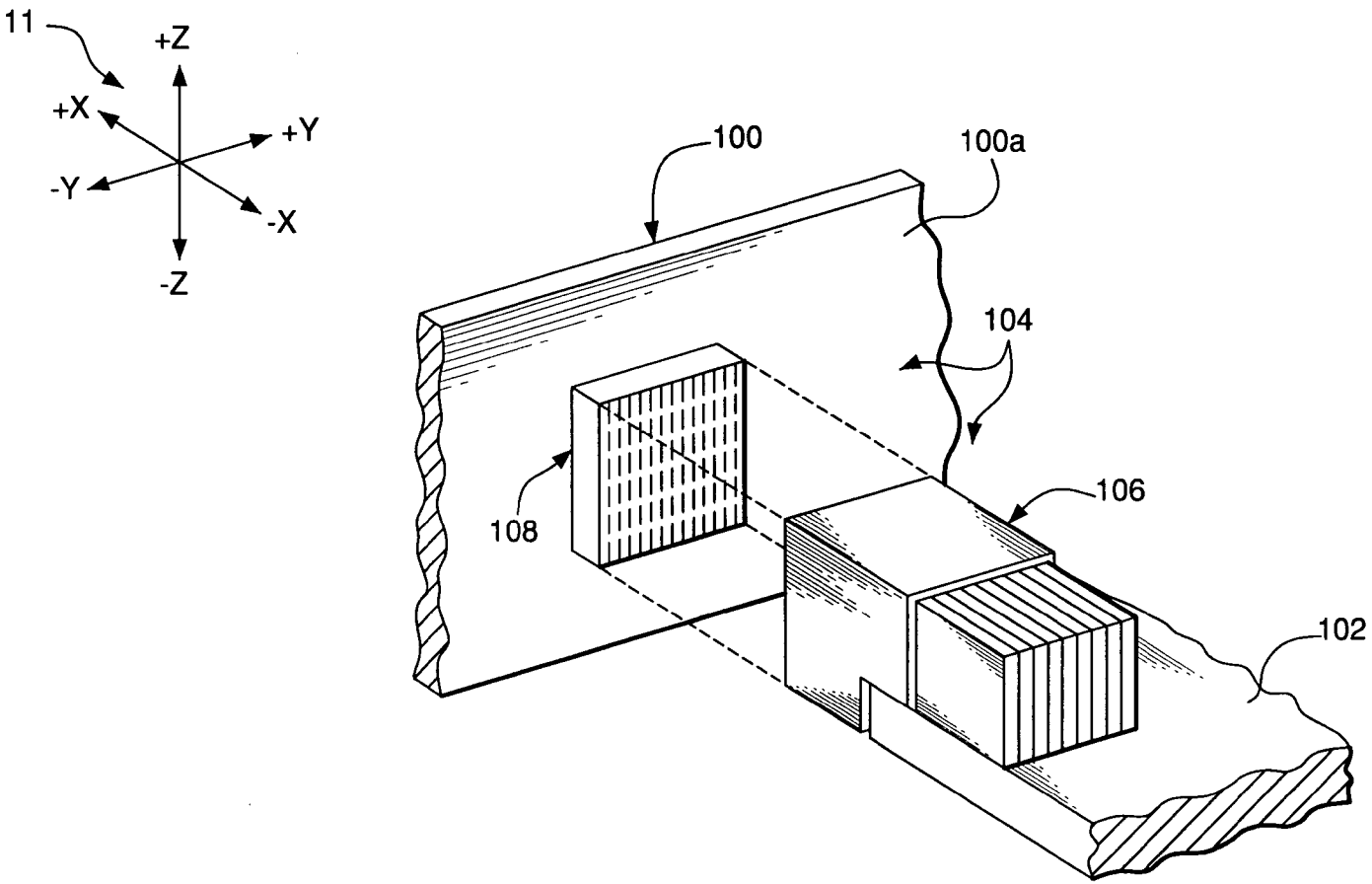
Fig. 1 Prior Art
FIG. 1 is a perspective view of a prior art connector system, depicting a receptacle connector of the connector system installed on a motherboard, and a header connector of the connector system installed on a daughter card, with the header connector and the receptacle connector in an unmated condition.
Figure 2:
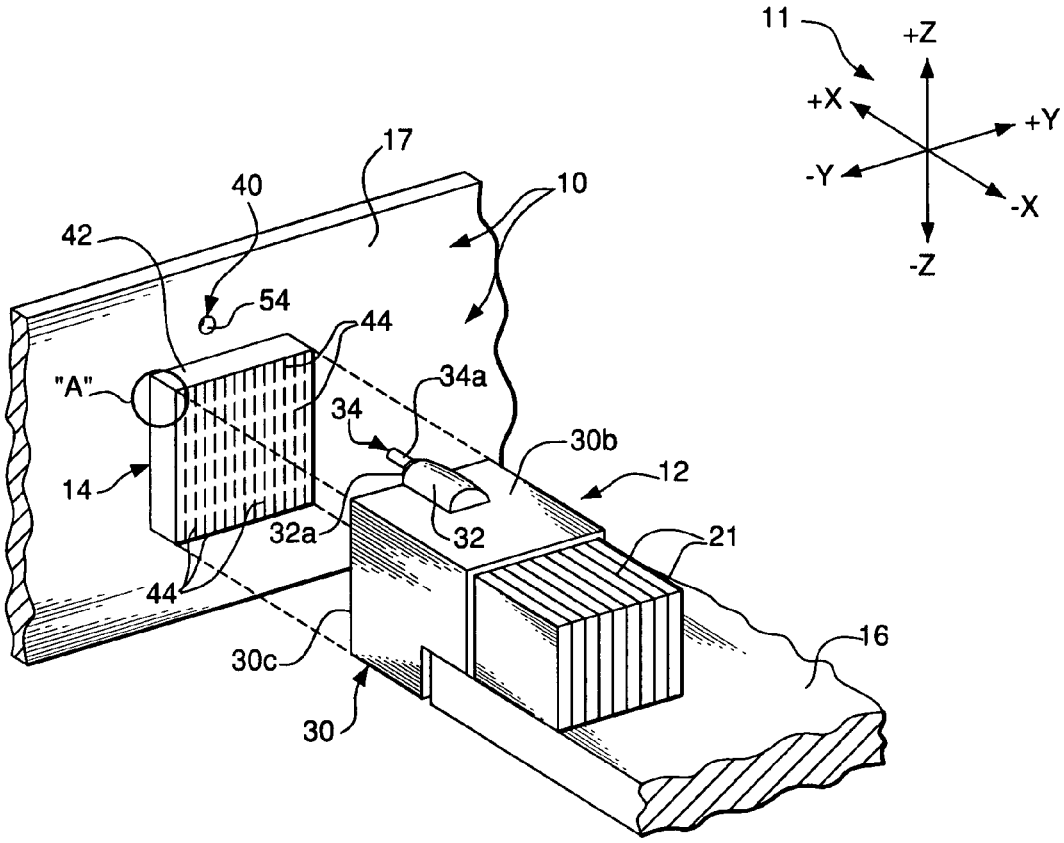
FIG. 2 is a perspective view of a preferred embodiment of a connector system, depicting a receptacle connector of the connector system installed on a motherboard, and a header connector of the connector system installed on a daughter card, with the header connector and the receptacle connector in an unmated condition.
Figure 3:
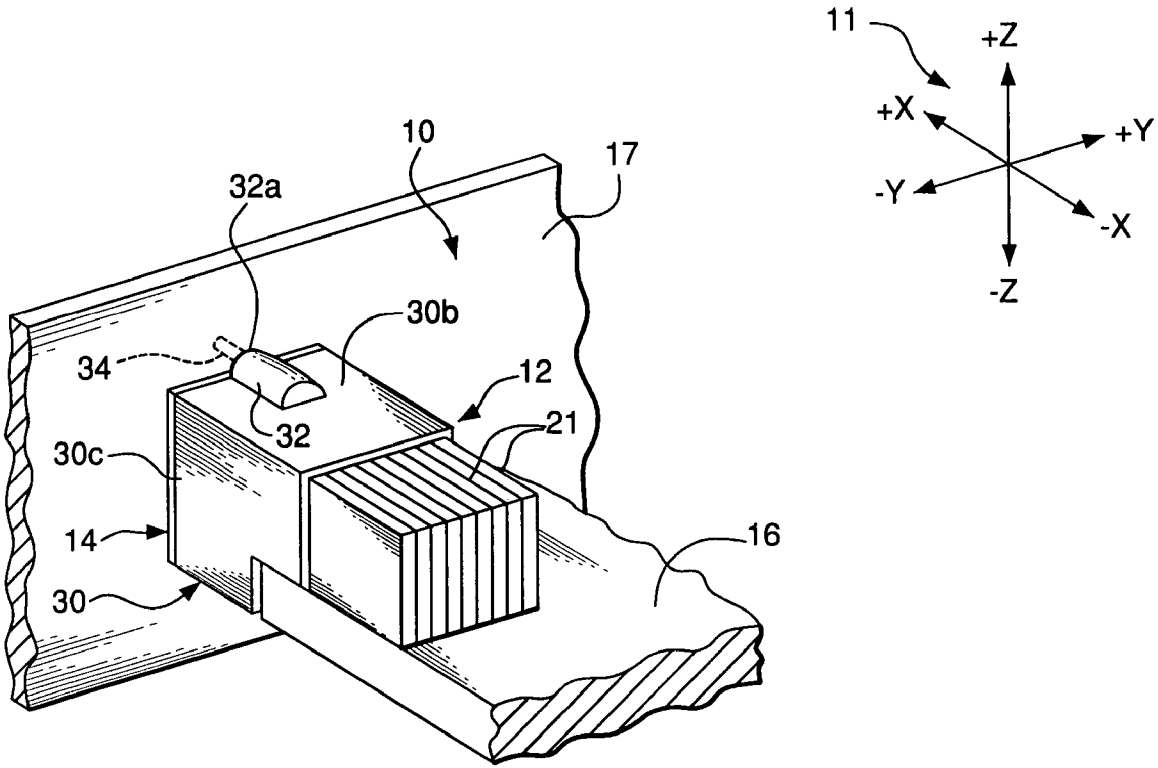
FIG. 3 is a perspective view of the connector system, mother board, and daughter card shown in FIG. 2, with the header connector and the receptacle connector in a mated condition.

The connector system 10 can be used to electrically connect a daughter card 16 and a motherboard 17. The header connector 12 can be mounted on the daughter card 16, and the receptacle connector 14 can be mounted on the motherboard 17. The motherboard 17 can be positioned in a substantially vertical orientation, and the daughter card 16 can be positioned in a substantially horizontal orientation, as depicted in FIGS. 2 and 3. Of course, the boards and the connectors can be reversed.

Figure 4:
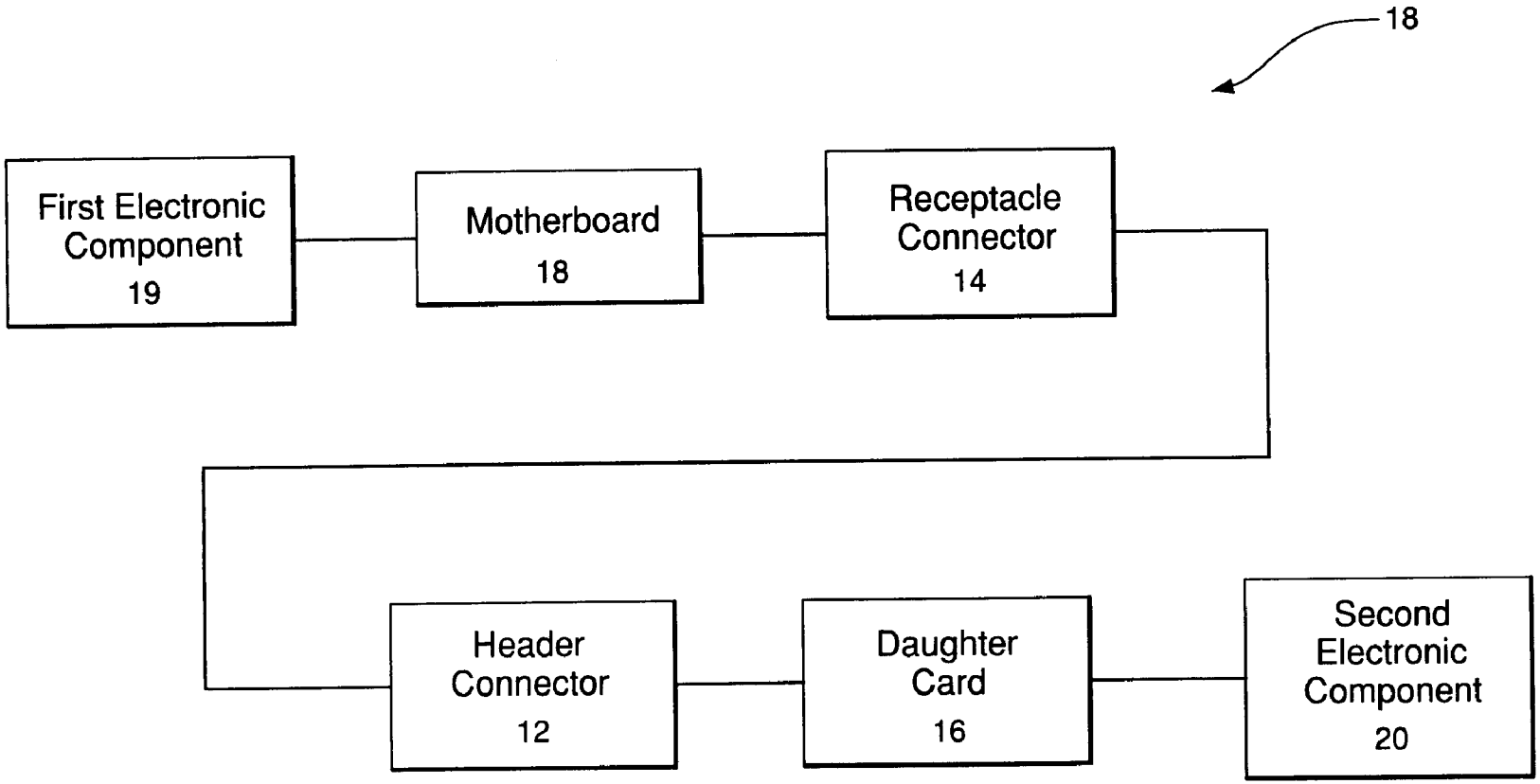
FIG. 4 is a block diagram depicting a system for electrically connecting a first and a second electronic component, the system incorporating the connector system shown in FIGS. 2 and 3.

The daughter card 16, motherboard 17, header connector 12, and receptacle connector 14 form a system 18 for interconnecting a first electronic component 19 and a second electronic component 20 (see FIG. 4).

The connector system 10 is disclosed on connection with the daughter card 16 and the motherboard 17 for exemplary purposes only. The connector system 10 can be used to interconnect other types of substrates, including printed circuit boards, printed wire boards, backplanes, etc.

Figure 6:
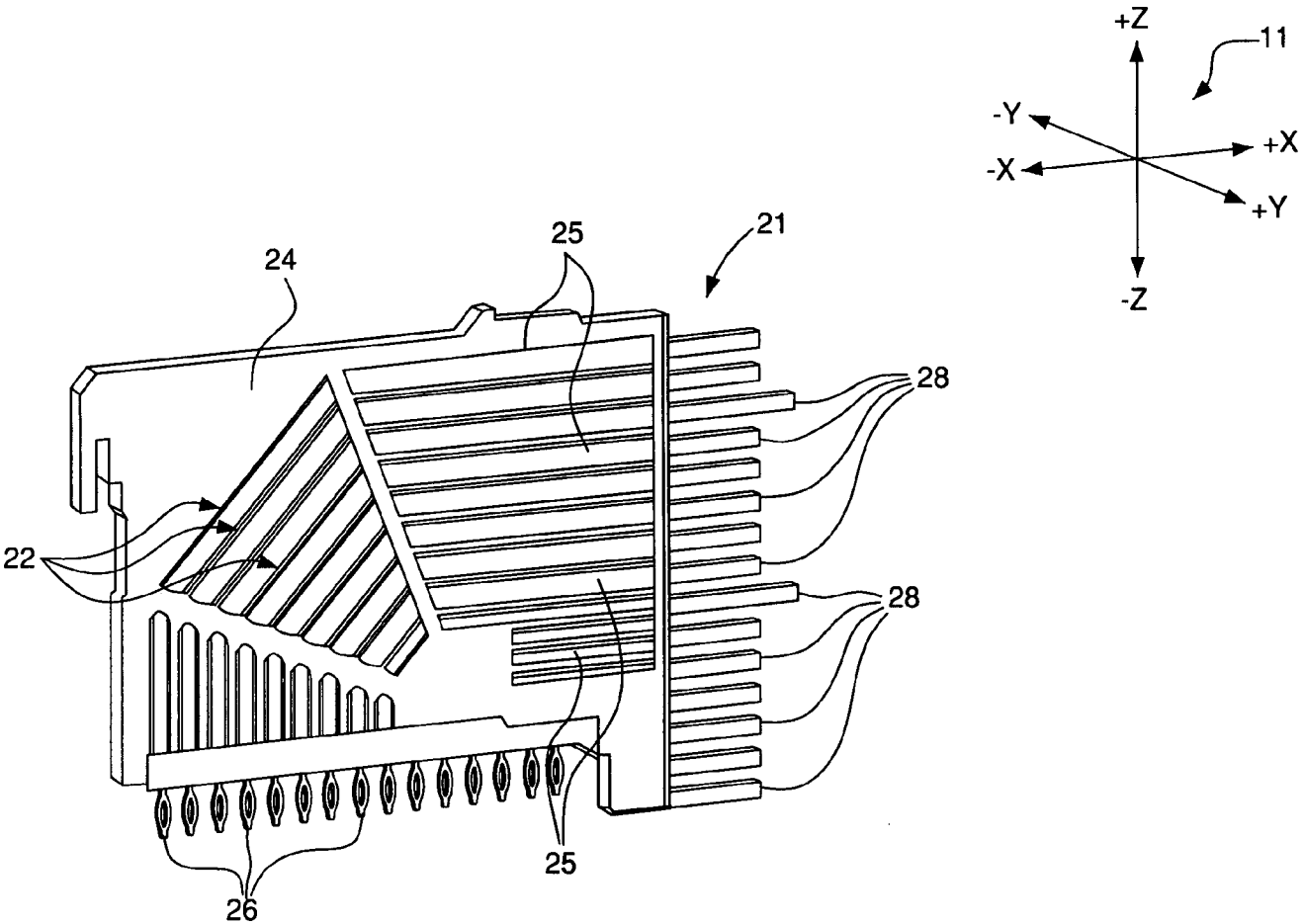
FIG. 6 is a perspective view of an insert molded leadframe assembly of the header connector shown in FIG. 5.

The header connector 12 can comprise an plurality of insert molded leadframe assemblies (IMLAs) 21 (see FIG. 6). Each IMLA 21 includes a plurality of electrical conductors 22 that extend through an overmolded frame 24. The frame 24 is formed from a suitable electrically-insulative material such as plastic.

Each electrical conductor 22 preferably includes a lead portion 25, a press-fit or BGA contact 26 adjoining a first end of the lead portion 25, and a blade contact 28 adjoining a second end of the lead portion 25. Each IMLA 21 can include fifteen of the electrical conductors 22. Alternative embodiments can include more or less than fifteen of the electrical conductors 22. Moreover, other types of contacts can be used in lieu of the blade contacts 28 and the press-fit contacts 26 in alternative embodiments. Also, alternative embodiments can be constructed without the use of IMLAs.

The electrical conductors 22 vary in length. The electrical conductors 22 are arranged in the frame 24 so that the blade contacts 28 form a vertically-oriented column adjacent a front edge of the frame 24, and the press-fit contacts 26 form a horizontally-oriented row along a bottom of the frame 24 (from the perspective of FIGS. 5 and 6).

Figure 5:
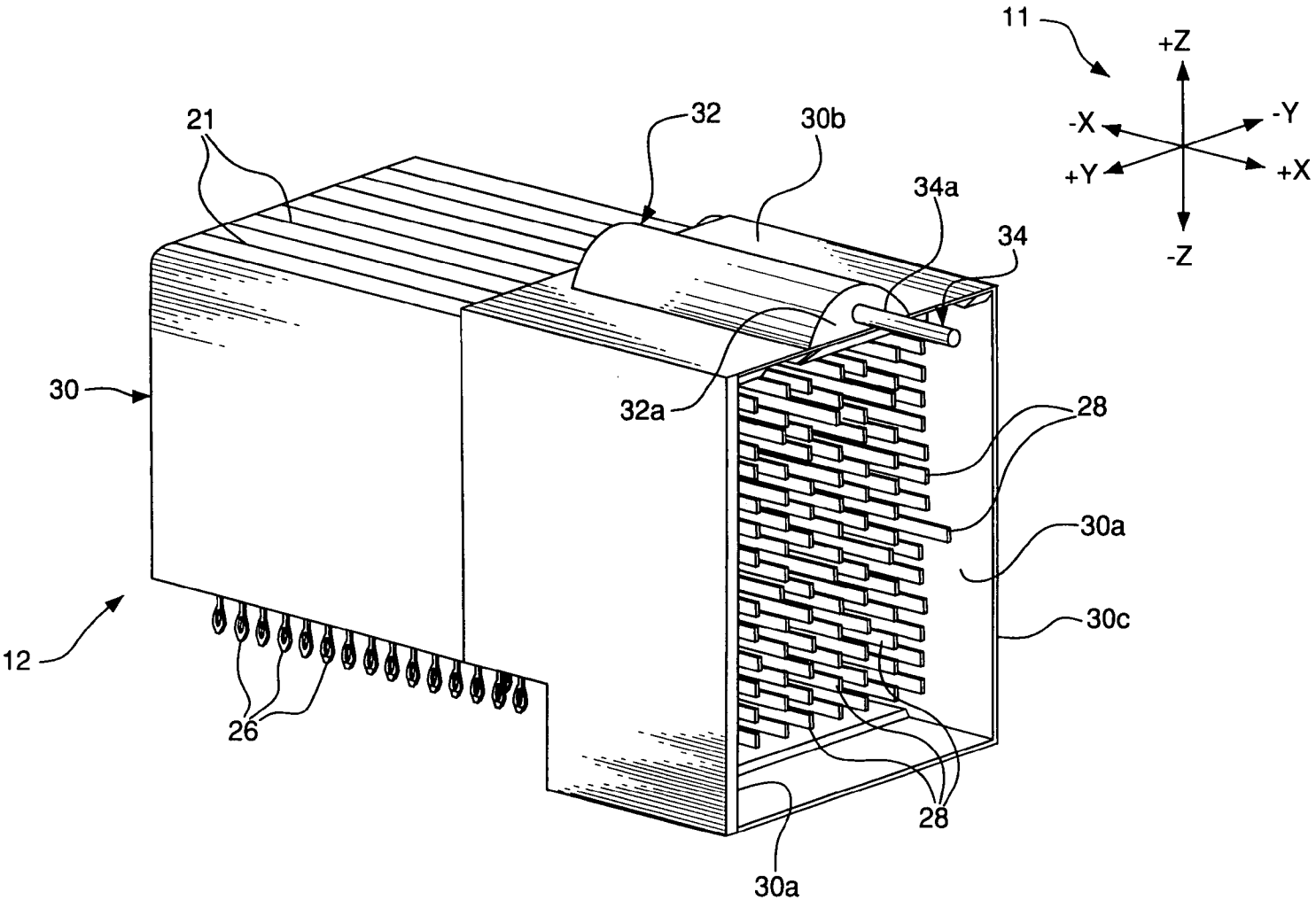
FIG. 5 is a perspective view of a header connector of the connector system shown in FIGS. 2–4.

As shown in FIGS. 2, 3, and 5, the header connector 12 also comprises an electrically-insulative housing 30. Ten of the IMLAs 21 are positioned within the housing 30 in a side by side arrangement. Alternative embodiments can include more or less than ten of the IMLAs 21. The press-fit contacts 26 extend downward from the housing 30 (from the perspective of FIGS. 5 and 6). The blade contacts 28 are positioned within a forward portion 30*a* of the housing 30.

The press-fit contacts 26 can engage plated through holes (not shown) formed in the daughter card 16, and the blade contacts 25 can engage associated contacts 44 of the receptacle 14, to establish electrical contact between the daughter card 16 and the motherboard 17.

The header connector 12 can be formed as a ball-grid array connector in alternative embodiments. In other words, a solder ball can be attached to the first end of the lead portion 25 on each electrical conductor 22 in lieu of the press-fit contacts 28, to form an array of solder balls on the bottom of the header connector 12. The solder balls can be subject to a reflow process after the header connector 12 is placed on the daughter card 16, to form solder connections between the header connector 12 and contact pads on the daughter card 16.

Referring again to FIGS. 2, 3, and 5, the housing 30 preferably includes raised portion 32 formed on an upper surface 30*b* of the housing 30 (see FIGS. 2, 3, and 5). A forward end 32*a* of the raised portion 32 preferably is substantially flush with a forward edge 30*c* of the housing 30.

The housing 30 also includes a projection 34. The projection 34 adjoins the forward end 32*a* of the raised portion 32, and extends forward in the "+x" direction therefrom. The raised portion 32 can be formed on surfaces of the housing 30 other than the upper surface 30*b* in alternative embodiments, so that the projection 34 is positioned at a location other than that depicted in FIGS. 2, 3, and 5.

Preferably, the projection 34 and the raised portion 32 are formed integrally with the remainder of the housing 30 by a suitable process such as injection molding. The projection 34 preferably has a substantially circular, tapered cross section. The projection 34 can also have a cross section other than circular in alternative embodiments.

As shown in FIGS. 2 and 3, the projection 34 is positioned on the housing 30 so that the projection 34 becomes disposed within a hole 40 formed in the motherboard 17 when the header connector 12 is mated with the receptacle connector 14. The hole 40 is depicted as a through hole in the figures. The hole 40 can extend only partially though the motherboard 17 in alternative embodiments. Moreover, the projection does not have to be integrally formed with the housing 30. For example, the housing 30 can define a projection receiving cavity, recess, or orifice that receives one end of a projection in the form of a pin, and the hole 40 can receive another end of the pin. It is also noted that the projection or projections can be positioned at any position along the housing. For example, the projection can be positioned on the housing opposite the mounting surface of the header (as shown), under the housing, at the corners of the housing, or other suitable positions.

Figure 11:
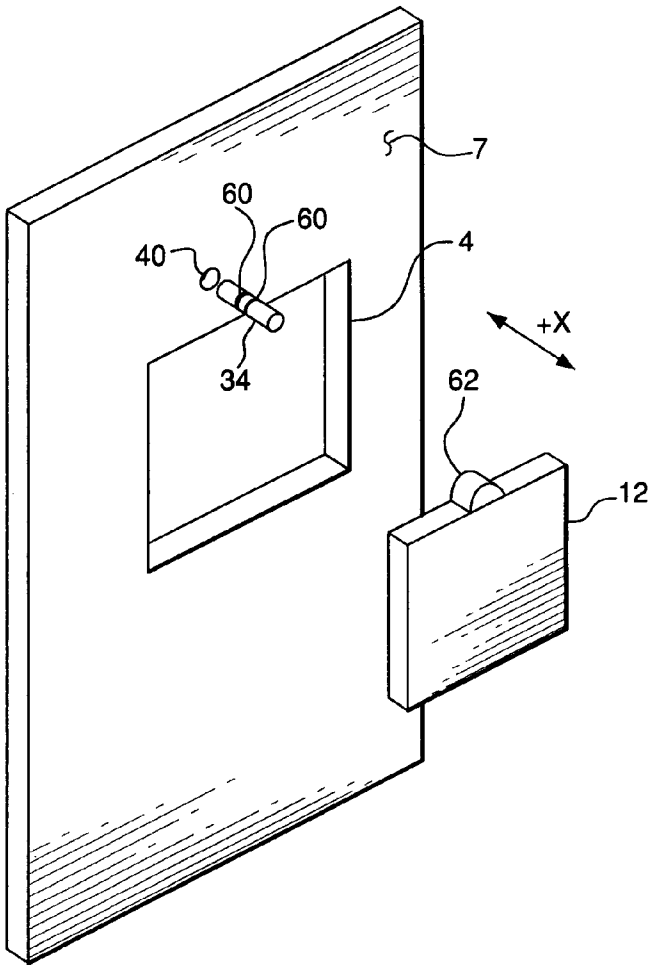
FIG. 11 is a perspective view of an alternative embodiment connector with a floating projection.

In an alternative embodiment, as shown in FIG. 11, the projection 34 can be loosely mounted to the receptacle connector 14 and slidable in the +x or mating direction. The receptacle connector 14 can also form projection guides 60 that guide and perhaps partially retain the projection 34 prior to the mating of the receptacle connector 14. When the header connector 12 is mated with the receptacle connector 14, or vice versa, the header connector 12 pushes on an end projection 34, such as by part 62, which in turn pushes the projection 34 into the hole 40. In this embodiment, the projection 34 is still not seated into the motherboard 17 until after reflow.

The resulting engagement of the projection 34 and the motherboard 17 can help to isolate the receptacle connector 14 from forces, such as shear force, resulting from the weight of the header connector 12 and the daughter card 16. In addition, the engagement of the projection 34 and the motherboard 17 can help to locate the header connector 12 in relation to receptacle connector 14 during mating. Details relating to these features are presented below.

Figure 7:
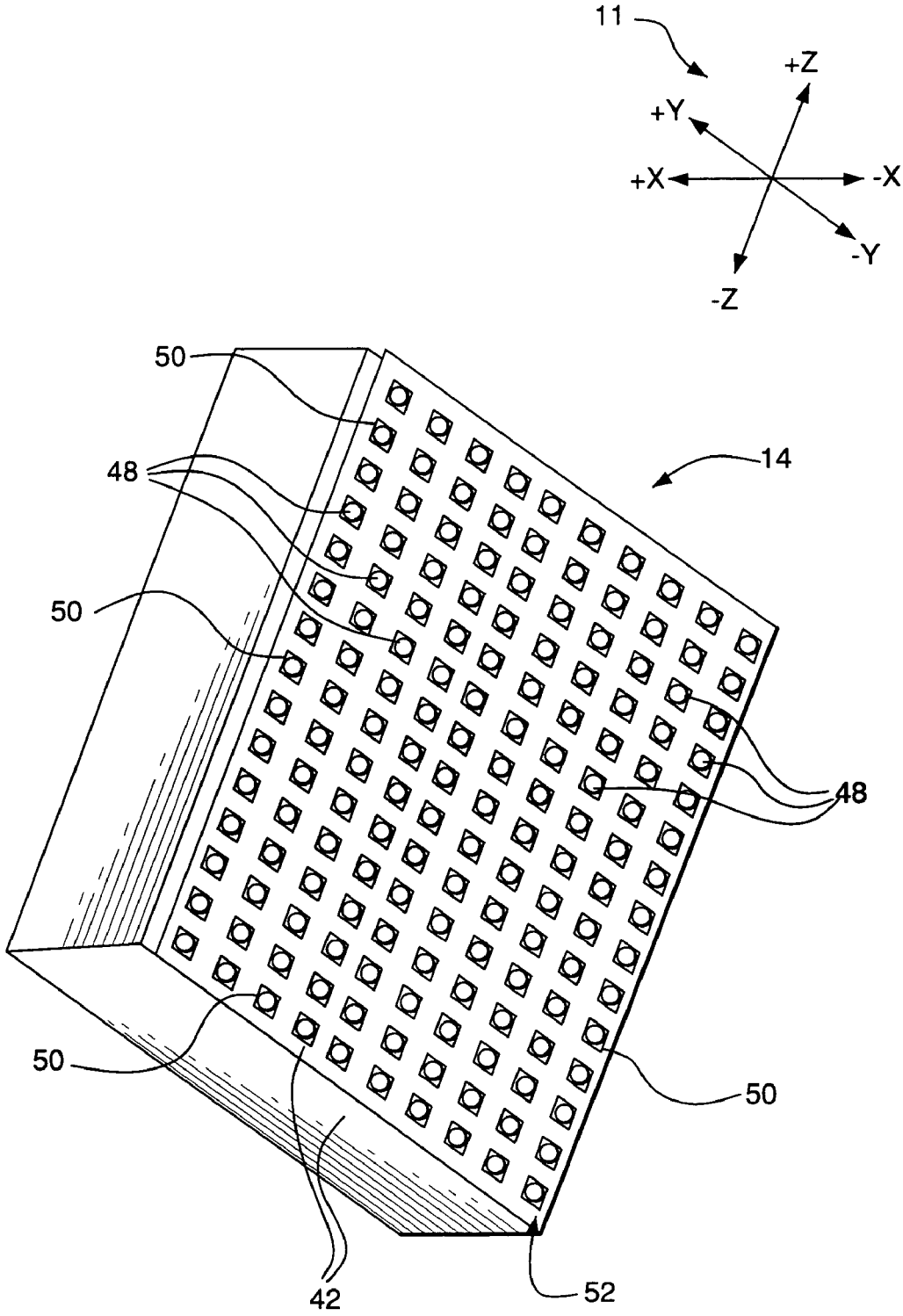
FIG. 7 is a perspective view of a receptacle connector of the connector system shown in FIGS. 2–4.
Figure 8:
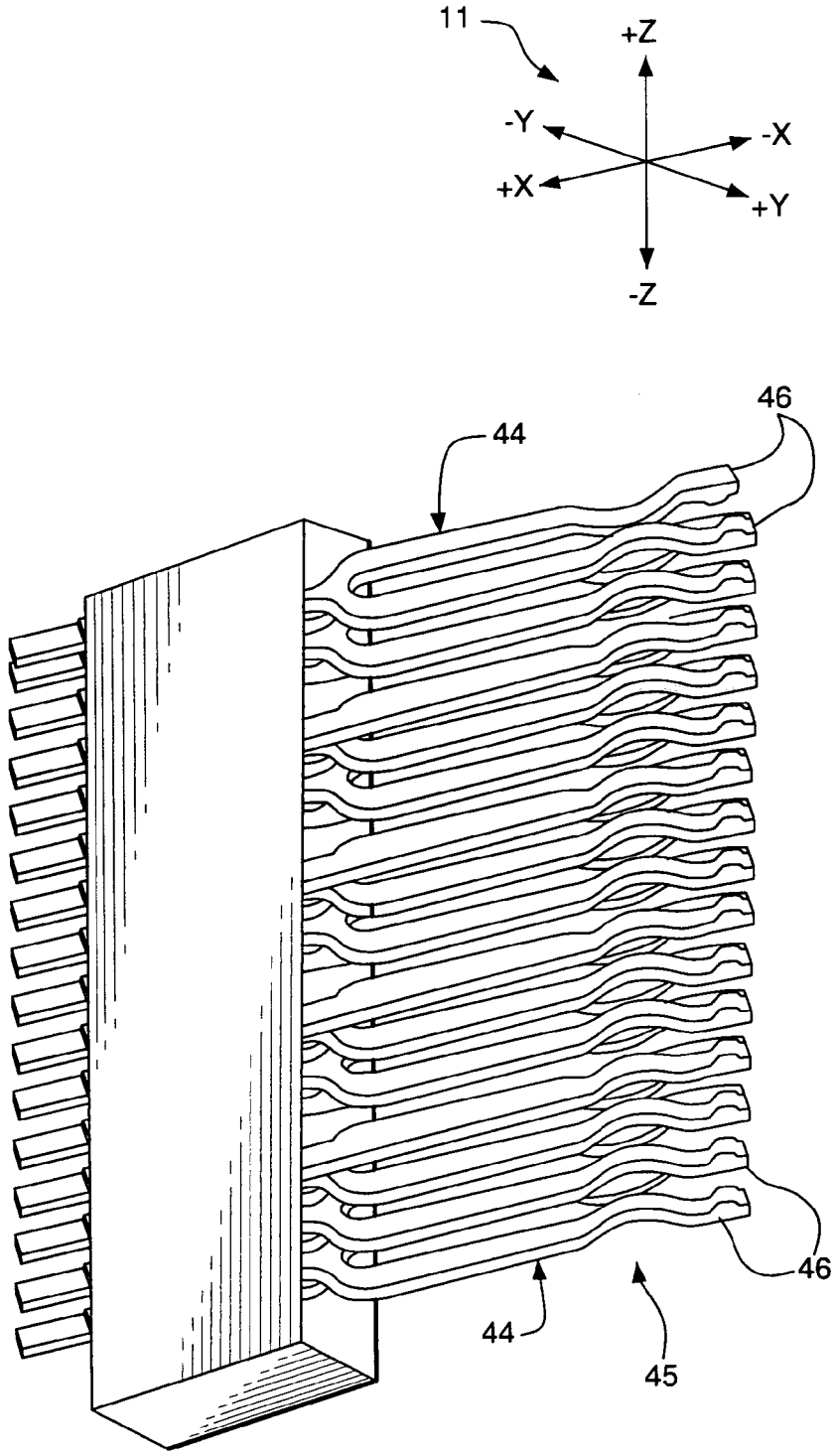
FIG. 8 is a perspective view of an insert molded leadframe assembly of the receptacle connector shown in FIG. 7.
Figure 9:
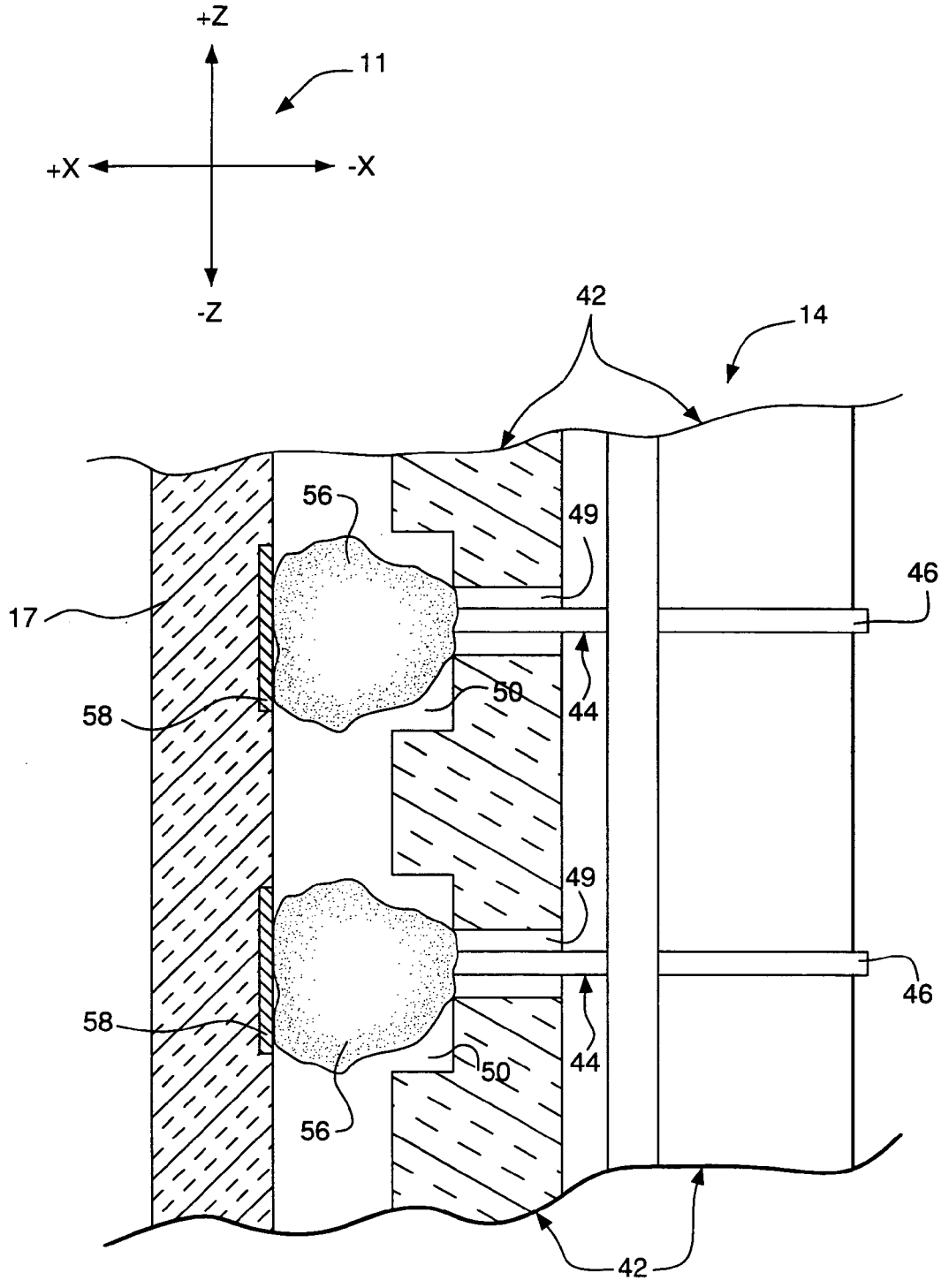
FIG. 9 is a magnified, cross-sectional side view of the area designated "A" in FIG. 2.

The receptacle connector 14 comprises a housing 42, and a plurality of the contacts 44 mounted in the housing 42 (see FIGS. 7–9). The contacts 44 preferably are dual-beam contacts. Other types of contacts can be used in alternative embodiments. In particular, a first end of each contact 44 preferably includes two beam portions 46 for engaging a corresponding contact blade 25 of the header connector 12.

The contacts 44 preferably are arranged in IMLAs 45 (see FIG. 8). The IMLAs 45 are positioned within the housing 42, and can be secured thereto by suitable retaining features (not shown) formed on the IMLAs 45 or the housing 42. Alternative embodiments of the receptacle connector 14 can be formed without IMLAs.

A plurality of through holes 49 and pockets 50 are formed in a rearward portion 42*a* of the housing 42 (see FIGS. 7 and 9). Each through hole 49 adjoins a corresponding pocket 50. Each contact 44 extends through a corresponding through hole 49, so that a second end of the contact 44 is positioned in the associated pocket 50. Alternative embodiments of the housing 42 can be formed without the pockets 50.

A solder ball 48 is attached to the second end of each contact 44. The solder balls 48 form a ball grid array 52 for electrically and mechanically connecting the receptacle connector 14 to the motherboard 17 (see FIG. 7). In particular, the solder balls 48 can be subject to a reflow process after the receptacle connector 16 is placed in contact with the motherboard 17, to form solder connections 56 that mechanically and electrically connect the associated contact 44 to a contact pad 58 on the motherboard 17 (see FIG. 9).

The beam portions 46 of each contact 44 engage a corresponding blade contact 28 of the header connector 12 when the header connector 12 and the receptacle connector 14 are mated, thereby establishing electrical contact between the header connector 12 and the receptacle connector 14.

The motherboard 17 has a hole 40 formed therein for receiving the projection 34, as noted above. The hole 40 is positioned above the points of contact between the motherboard 17 and the receptacle connector 14, from the perspective of FIG. 2. The projection 34 can be positioned at a location on the housing 30 other than that shown in FIGS. 2, 3, and 5 in alternative embodiments, as noted above. Hence, the hole 40 can be formed at a location on the motherboard 17 other than that depicted in FIG. 2. Furthermore, there can be multiple projections/holes.

The projection 34 becomes disposed within the hole 40 when the header connector 12 is mated with the receptacle connector 14, as noted previously. More particularly, the header connector 12 can be mated with the receptacle connector 14 by substantially aligning the projection 34 with the hole 40, and then moving the header connector 12 toward the receptacle connector 14, in the "+x" direction.

Alternatively, one end of the projection can be positioned in the hole, and the other end can be received in a projection receiving cavity or orifice defined in the header or receptacle connector.

Movement of the header connector 12 toward the receptacle connector 14 causes each of the blade contacts 28 of the header connector 12 to become disposed between the beam portions 46 of a corresponding one of the contacts 44 of the receptacle connector 14. Movement of the header connector 12 toward the receptacle connector 14 also causes the projection 34 to enter the hole 40 in the motherboard 17.

The hole 40 is defined by a surface 54 of motherboard 17, and can be an inexpensive drill hole. The projection 34 preferably fits snugly within the hole 40 when the header connector 12 and the receptacle connector 14 are mated. In other words, the hole 40 and the projection 34 preferably are sized so that only a minimal clearance exists between the surface 54 and an outer surface 34*a* of the projection 34, or between the outer surface of the projection and an inner surface of a projection receiving orifice, cavity, or recess defined by the header.

The projection 34 can transmit lateral (y-direction) and vertical (z-direction) forces from the header connector 12 to the motherboard 17. This feature can substantially isolate the receptacle connector 14 (and the solder connections 51) from mechanical loads acting on the header connector 12.

Contact between the projection 34 and the motherboard 17 can facilitate transmission of at least a portion of the weight of the daughter card 16 and the header connector 12 to the motherboard 17 by way of the projection 34. In other words, it is believed that the motherboard 17 can exert a reactive force against the projection 34 in response to the weight of the header connector 12 and the daughter card 16 acting on the surface 54.

The header connector 12 and the daughter card 16 can thereby be suspended, at one end, from the motherboard 17 by way of the projection 34. More particularly, the use of the projection 34 optimally can remove the receptacle connector 14 from the load chain between the header connector 12 and the motherboard 17, so that the receptacle connector 14 is substantially isolated from the weight of the daughter card 16 and the header connector 12.

Isolating the receptacle connector 14 from the weight of the daughter card 16 and the header connector 12 can substantially reduce the stresses on the solder connections 51. In other words, the use of the projection 34 eliminates the need for the solder connections 51 to support a substantial portion of the weight of the header connector 12 and the daughter card 16. The projection 34 thereby can relieve the strain on the solder connections 51 caused by the weight. Hence, the reliability and useful life of the solder connections 51 potentially can be improved through the use of the projection 34.

The projection 34 also can substantially isolate the receptacle connector 14 (and the solder connections 51) from impact loads acting on the header connector 12 and the daughter card 16 in the vertical ("z") and lateral ("y") directions. In other words, impact loads acting on the header connector 12 and the daughter card 16 can be transmitted to the motherboard 17 by way of the housing 30 and the projection 34, further reducing the potential stresses to which the solder connections 51 will be subjected to during their service life.

Moreover, the projection 34 can act as a locating device to help position the header connector 12 during mating with the receptacle connector 14. In particular, aligning the pin 34 with the hole 40 in the motherboard 17 can help to align the header connector 12 with the receptacle connector 14 so that the connectors 44 of the receptacle connector 14 can engage the corresponding blade contacts 28 of the header connector 12.

The projection 34, it is believed, is subject only to shear stresses when performing its strain relief function. The projection 34 therefore does not need to be restrained in the axial ("x") direction. Hence, the use of the projection 34 does not necessitate any additional installation steps (such as placing a nut or other restraining device on the projection 34), and does not increase the parts count of the connector system 10.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

Figure 10:
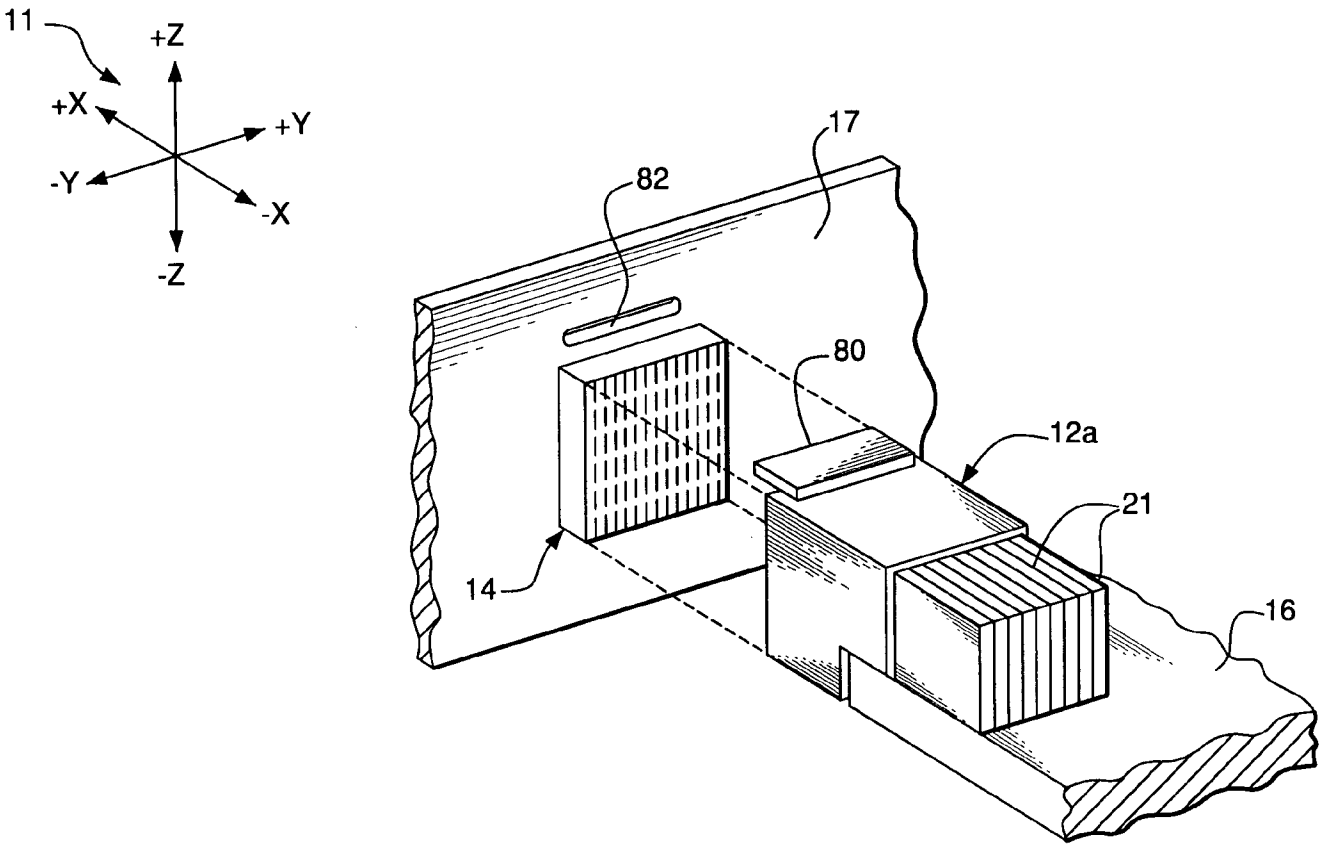
FIG. 10 is a perspective view of an alternative embodiment of the connector system shown in FIGS. 2–4, with a header connector and a receptacle connector of the alternative embodiment in an unmated condition.

The projection 34 can have a cross section other than circular in alternative embodiments, as noted previously. For example, FIG. 10 depicts an alternative embodiment of the header connector 12 in the form of a header connector 12*a*. The header connector 12*a* has an elongated, or bar-shaped projection 80. The projection 80 can be received in an elongated slot 82 formed in the motherboard 17 when the header connector 12*a* is mated with the receptacle connector 14.

Moreover, the header connector 12 and the receptacle connector 14 have been described in detail for exemplary purposes only. The principles of the invention can be applied to other types of electrical connectors that are mounted to orthogonally-positioned PCBs.

What is claimed is:

1. A connector system, comprising:

a first and a second substrate;

a first electrical connector mounted on a major surface of the first substrate, the first electrical connector comprising a housing and a contact mounted on the housing; and a second electrical connector mounted on the second substrate so that the second electrical connector faces a major surface of second substrate, the second electrical connector comprising a housing having a projection, and a contact mounted on the housing, wherein the second electrical connector mates with the first electrical connector so that the major surfaces of the first and second substrates are substantially perpendicular, the contact of the first electrical connector electrically contacts the contact of the second electrical connector, and the projection contacts the first substrate so that at least a portion of the weight of the second electrical connector and the second substrate is transmitted to the first substrate by way of the projection wherein the second electrical connector and the second substrate are suspended from the first substrate by the projection, wherein the second electrical connector is capable of mating with the first electrical connector when the first and second electrical connectors are located on the same side of the first substrate.

2. The system of claim 1, wherein the projection is a pin and the housing of the second electrical connector has a projection receiving cavity formed therein for receiving an end of the pin.

3. The system of claim 1, wherein the projection is unitarily formed with a remainder of the housing of the second electrical connector.

4. The system of claim 1, wherein the first electrical connector is a receptacle connector and the second electrical connector is a header connector.

5. The connector system of claim 1, wherein the projection has a substantially circular cross section.

6. The system of claim 1, wherein the housing of the second electrical connector receives the housing of the first electrical connector when the first and second electrical connectors are mated.

7. The system of claim 1, wherein the projection substantially isolates the first electrical connector from the weight of the second electrical connector and the second substrate.

8. The system of claim 1, wherein the first electrical connector is configured for mounting on a first side of the first substrate, and the projection enters the first substrate from the first side when the first and second electrical connectors are mated.

9. The connector system of claim 1, wherein the projection is positioned in a hole formed in the first substrate when the first electrical connector and the second electrical connector are mated.

10. The connector system of claim 9, wherein the projection can substantially align with the hole when the contact of the second electrical connector is substantially aligned with the contact of the first electrical connector.

11. The connector system of claim 9, wherein no substantial clearance exists between the projection and a perimeter of the hole when the projection is positioned in the hole.

12. The connector system of claim 9, wherein the first electrical connector and the second electrical connector are mated by moving the second electrical connector in a first direction in relation to the first electrical connector so that the contact of the second electrical connector engages the contact of the first electrical connector, and a direction of insertion of the projection in the hole coincides substantially with the first direction.

13. The connector system of claim 12, wherein the projection substantially isolates the first electrical connector from forces acting on the second electrical connector in directions substantially perpendicular to the first direction.

14. The connector system of claim 1, wherein the housing of the second electrical connector has a raised portion formed thereon and the projection extends from the raised portion.

15. The connector system of claim 14, wherein the raised portion is formed on an upper surface of the housing of the second electrical connector.

16. The connector system of claim 1, wherein the contact of the second electrical connector is a blade contact and the contact of the first electrical connector is a dual beam contact.

17. The connector system of claim 16, wherein the second electrical connector further comprises an electrical conductor, the electrical conductor comprising the blade contact, a lead portion adjoining the blade contact, and a press fit contact adjoining the lead portion.

18. The connector system of claim 17, wherein the second electrical connector further comprises an insert molded leadframe assembly and a plurality of the electrical conductors mounted on the insert molded leadframe assembly.

19. The connector system of claim 17, wherein the first electrical connector further comprises a solder ball attached to the contact of the first electrical connector for electrically and mechanically coupling the contact to a contact pad on the first substrate.

* * * * *